US007902468B2

(12) United States Patent
Miyata et al.

(10) Patent No.: US 7,902,468 B2
(45) Date of Patent: Mar. 8, 2011

(54) DETENT CHANGEOVER SWITCH APPARATUS

(75) Inventors: Masahiko Miyata, Aichi (JP); Seiji Ishigaki, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 559 days.

(21) Appl. No.: 12/068,340

(22) Filed: Feb. 5, 2008

(65) Prior Publication Data

US 2008/0190752 A1 Aug. 14, 2008

(30) Foreign Application Priority Data

Feb. 8, 2007 (JP) ..... 2007-029190

(51) Int. Cl.
*H01H 9/20* (2006.01)

(52) U.S. Cl. ..... 200/50.01; 200/565

(58) Field of Classification Search ..... 200/565, 200/50.01

See application file for complete search history.

(56) References Cited

U.S. PATENT DOCUMENTS

| | | | | |
|---|---|---|---|---|
| 7,714,242 | B2 * | 5/2010 | Ishigaki et al. | 200/336 |
| 7,732,724 | B2 * | 6/2010 | Otani et al. | 200/565 |
| 2008/0173112 | A1 * | 7/2008 | Hiroe et al. | 74/10.41 |
| 2008/0197004 | A1 * | 8/2008 | Ishigaki et al. | 200/336 |

FOREIGN PATENT DOCUMENTS

JP 2006-178861 7/2006

* cited by examiner

*Primary Examiner* — Renee S Luebke
*Assistant Examiner* — Lisa Klaus
(74) *Attorney, Agent, or Firm* — Morgan, Lewis & Bockius LLP

(57) ABSTRACT

A small click generating member is mounted on a yoke, and a large click generating member is rotatably mounted on an operating shaft. A plunger case is relatively rotatably mounted on the operating shaft, and large and small click pieces are mounted on the plunger case. An electromagnet is mounted on the yoke, and a plunger magnetic body attractable to the electromagnet is mounted on the plunger case. A magnet is mounted to cover the yoke. By changing over the supply of electricity to the electromagnet among a non-electricity-supply state, a backward connection electricity supply state and a forward connection electricity supply state, a generated coil magnetic field and a magnetic field of the magnet are applied in a cooperative manner, a magnetic circuit generated in the yoke can be changed over, and clicks are changed over among large click feeling, small click feeling and a fixed state.

3 Claims, 13 Drawing Sheets

DETENT CHANGEOVER SWITCH APPARATUS

BACKGROUND OF THE INVENTION

The present invention relates to a detent changeover switch apparatus capable of changing over click feeling generated by an operating portion of an operating switch.

Conventionally, as an input operation system for performing operation setting of various vehicle-loaded equipment such as an air conditioning device and an audio device, various kinds of operating switches are mounted on a vehicle corresponding to respective functions. As one example, with respect to the operating switches of the air conditioning device, for example, a temperature setting switch for setting a supply-air temperature, an air volume setting switch for setting an air volume, an air blow direction setting switch for setting an air blow and the like are used. As such a group of switches, a rotary operating switch, that is, a rotary switch which performs setting of various functions by rotatably operating a dial knob of a rotational operation type as an operating portion has been popularly used.

Further, this kind of rotary switch is provided with a detent mechanism capable of imparting a desired operation force or click feeling to the dial knob as a click for ensuring an operation of the dial knob by enhancing operation feeling of the dial knob. As one example of such a detent mechanism, there has been known a motor-driven click generating mechanism shown in JP-A-2006-178861 which imparts click feeling to a dial knob of a rotary switch using a motor, for example. In the disclosed technique, the motor is connected to the dial knob of the rotary switch, and upon a rotational operation of the dial knob, the motor is driven in the direction opposite to the knob operating direction thus imparting a reaction force to the dial knob and hence, an operating force is imparted to an operator as click feeling.

Recently, to realize the reduction of the number of parts of the operating switch, there has been an attempt to use one rotary switch in common among a plurality of selection functions. In this kind of operating switch having the common use structure, a switch controller which constitutes a control unit of the input operation system brings a switch determination mode into a function selection setting mode in a switch determination initial state. At this point of time, when the dial knob is operated, in response to a switch signal acquired from the rotary switch, a vehicle-loaded equipment which the operator requires setting a function thereof is selected and designated. The switch controller, after the selection and the designation of the vehicle-loaded equipment, changes over the switch determination mode to a detail setting mode. When the dial knob is operated at this point of time, in response to a switch signal acquired from the rotary switch, the detail of the selected and designated vehicle-loaded equipment is set to a state corresponding to the switch operation.

In case of the operating switch having the common-use structure, it is desirable that the click feeling generated in the rotary switch by the detent mechanism differs for every selection function. Here, when a motor-driven click generating mechanism described in JP-A-2006-178861 is used as a detent mechanism, in changing over click feeling of the dial knob based on respective selection functions, the changeover of click feeling is performed by controlling a reaction force imparted to the dial knob by a motor based on the respective selection functions. That is, when the strong click is necessary, the reaction force of the motor is increased so as to allow the dial knob to generate the strong click, while when the weak click is necessary, the reaction force of the motor is decreased so as to allow the dial knob to generate the weak click.

Further, the rotary switch of the air conditioner is, in view of setting of temperature or selection functions, often a switch which limits a rotational operation range in which the dial knob is operated within a predetermined rotational operation range. Accordingly, this type of rotary switch is configured to be rotary operated within a range of 120 degrees, 180 degrees, 270 degrees or the like, for example, corresponding to a usage of the rotary switch. Here, when the motor-driven click generating mechanism described in JP-A-2006-178861 is used as the detent mechanism, to bring the dial knob into a fixed state at a preset stop position, a reaction force larger than a reaction force generated at the time of generating click by the motor is generated thus restricting the further rotational operation of the dial knob.

However, when the motor-driven click generating mechanism is used as the detent mechanism, it is necessary to perform processing for a control of the reaction force generated by the motor for changing over the click feeling generated in the dial knob by the detent mechanism or bringing the dial knob into a fixed state. Accordingly, this type of motor control requires complicate processing and hence, when the motor-driven click generating mechanism is used as the detent mechanism, a control unit of a switch system requires a complete motor control. Accordingly, also for reducing a burden on processing of the control unit, there has been a demand for changeover and fixing of click of the rotary switch which can be performed with processing as simple as possible.

SUMMARY OF THE INVENTION

It is an object of the present invention to provide a detent changeover switch apparatus which can perform changeover or fixing of click feeling generated by an operating switch with simple processing.

In order to solve the problem, the present invention provides the following arrangements.

(1) A detent changeover switch apparatus performing a selection function operation, comprising:

a housing;

an operating portion to be operated by an operator to rotate with respect to the housing;

an operating shaft extending integrally from the operating portion;

a plurality of detent mechanisms, each including a detent member and a piece member rotatable relatively to the detent crest member to generate a click feeling;

an electromagnet that is provided at the housing and selectively fixes the crest members of the detent mechanisms to the housing by a magnetic attracting action;

an auxiliary magnetic filed generating member capable of imparting an auxiliary electric field to a magnetic circuit generated by the electromagnet;

a magnetic attracting member that fixes the operating shaft to the housing by the magnetic attracting action of the electromagnet when a large magnetic field is imparted to the magnetic attracting member;

a detector that detects an operation state when the operator operates the operating portion; and a controller that performs a drive control of the electromagnet based on a detection quantity of the detector for changing over a circuit state of a magnetic circuit generated in the housing by the electromagnet and the auxiliary magnetic field generating member, thereby changing over the click feeling and a fixed state of the operating portion.

(2) The detent changeover switch apparatus according to (1), wherein one of the detent mechanisms includes an interlocking member movable together with the operating shaft, a mounting member mounted on the operating shaft in a relatively movable manner, and a part group for large click positioned between the interlocking member and the mounting member, the other detent mechanism includes the mounting member, a support member fixed to the housing and a part group for small click positioned between the mounting member and the support member, a magnetic body magnetically attractable to the electromagnet is integrally mounted on the mounting member, and the controller changes over a drive state of the electromagnet among a non-electricity-supply state, a backward connection electricity supply state and a forward connection electricity supply state to bring a magnetic attracting state between the electromagnet and the magnetic body and a magnetic attracting state between the magnet attracting member and the housing into different states, respectively, for changing over the click feeling and the fixed state.

(3) The detent changeover switch apparatus according to (2), wherein the auxiliary magnetic field generating member generates the auxiliary magnetic field by forming a magnetic path using the housing and the operating shaft made of a magnetic material, the electromagnet has an electromagnetic magnetic field directed along the magnetic path of the auxiliary magnetic field, and when the operating portion is changed over into the fixed state, the controller performs the drive control of the electromagnet for changing over the magnetic field of the magnetic circuit generated by the housing and the operating shaft.

According to the above arrangement, the controller changes over the magnetic field which the electromagnet generates due to a changeover control of an electricity-supply state of the electromagnet based on a detection quantity of the detector. Here, a magnetic circuit generated in the inside of the operating switch is changed over due to the cooperative operation of the drive magnetic field generated by the electromagnet and the auxiliary magnetic field generated by the auxiliary magnetic field generating member in an auxiliary manner. When the magnetic circuit in the inside of the operating switch is changed over, for example, a magnetic field balance between the drive magnetic field generated by the electromagnet and the auxiliary magnetic field generated by the auxiliary magnetic field generating member is changed and hence, the detent mechanism driven by the magnetic field change is selected from the plurality of detent mechanisms or the strong magnetic field is generated in the housing so as to fix the operating portion to the housing thus bringing the operating portion into a non-operable fixed state.

Here, as explained in the description of the Background Art, when the structure which uses the motor is adopted as the detent mechanism, to change over the click feeling or the fixed state of the operating portion, it is necessary to perform the complicate control processing such as sequential changeover of a quantity of electric current of the motor. To the contrary, according to the arrangement of the present invention, the changeover of the click feeling of the operating portion or the changeover of the fixed state of the operating portion is performed by controlling the supply of electricity to the electromagnet. In this manner, it is sufficient for this type of electromagnet control to perform the simple control processing which merely changes ON-OFF of electric current flowing in the electromagnet and hence, it is possible to perform the changeover of click feeling or the changeover of fixing of the operating portion with the simple control processing.

According the above arrangement, when the electromagnet is brought into a non-electricity-supply state, for example, the operating switch assumes a state in which the magnetic circuit is generated due to the auxiliary magnetic field of the auxiliary magnetic field generating member. However, the auxiliary magnetic field generating member is provided for generating the auxiliary magnetic field and hence, the magnetic attracting member mounted on the operating portion is not brought into a state in which the magnetic attracting member is magnetically attracted to the housing whereby the operating portion can be smoothly operated. Here, since the electromagnet is in a non-electricity-supply state, the mounting portion is not fixed to the housing side. Accordingly, when the operating portion is operated in such a state, the slide resistance of the large detent part group is set larger than the slide resistance of the small detent part group and hence, the mounting member is moved along with the movement of the operating portion together with the interlocking member due to this slide resistance relationship, and the mounting member assumes a state in which the mounting member is movable relative to the support member on the housing side. Accordingly, the large detent mechanism between the interlocking member and the mounting member does not function, while the small detent mechanism between the mounting member and the support member functions thus allowing the operating portion to generate the small click.

Further, when the electromagnet is brought into a backward connection electricity supply state, the electromagnetic magnetic field generated by the electromagnet and the auxiliary magnetic field generated by the auxiliary magnetic field generating member assumes directions opposite from each other and hence, no large magnetic field is applied to the magnetic attracting member mounted on the operating portion whereby the operating portion is not magnetically attracted to the housing thus allowing the operation of the operating portion. Here, the electromagnet is in an electricity supply state, and the electromagnet and the magnetic body are magnetically attracted to each other and hence, the mounting portion integrally formed with the magnetic body is fixed to the housing side. When the operating portion is operated in such a state, the mounting member is fixed to the support portion side at this point of time and hence, the interlocking member assumes a state in which the interlocking member is movable relative to the mounting portion. Accordingly, the small detent mechanism between the mounting member and the support member does not function, while the large detent mechanism between the interlocking member and the mounting member functions thus allowing the operating portion to generate the large click.

Further, when the electromagnet is brought into a forward connection electricity supply state, the electromagnetic magnetic field generated by the electromagnet and the auxiliary magnetic field generated by the auxiliary magnetic field generating member assumes the same direction. Here, a resultant magnetic field of the electromagnetic magnetic field and the auxiliary magnetic field is generated in the operating switch and hence, the magnetic attracting member assumes a state in which the magnetic attracting member is magnetically attracted to the housing due to such a magnetic field whereby the operating portion assumes a fixed state which prevents the further operation of the operating portion. Accordingly, with respect to the detent changeover switch apparatus having the above-mentioned operational state, from a viewpoint of arrangement of parts, the mounting parts can be used as common-use parts between the large detent mechanism and the small detent mechanism and hence, the number of operating switch parts can be highly effectively reduced.

According to the above arrangement, the electromagnetic magnetic field which the electromagnet generates takes the direction along the auxiliary magnetic field generated by the auxiliary magnetic field generating member and hence, in overlapping the drive magnetic field and the auxiliary magnetic field to change over the generated click of the operating portion, the drive magnetic field can easily applied to the auxiliary magnetic field. Accordingly, the circuit condition of the magnetic circuit generated in the click generator and the magnetic attracting member can be more reliably changed over thus leading to the more reliable changeover of click feeling.

According to the present invention, the changeover and fixing of click feeling generated in the operating switch can be performed with simple processing.

DETAILED DESCRIPTION OF PREFERRED EMBODIMENTS

One embodiment of a detent changeover switch apparatus which embodies the present invention is explained in conjunction with FIG. 1 to FIG. 10 hereinafter.

Figure 1:
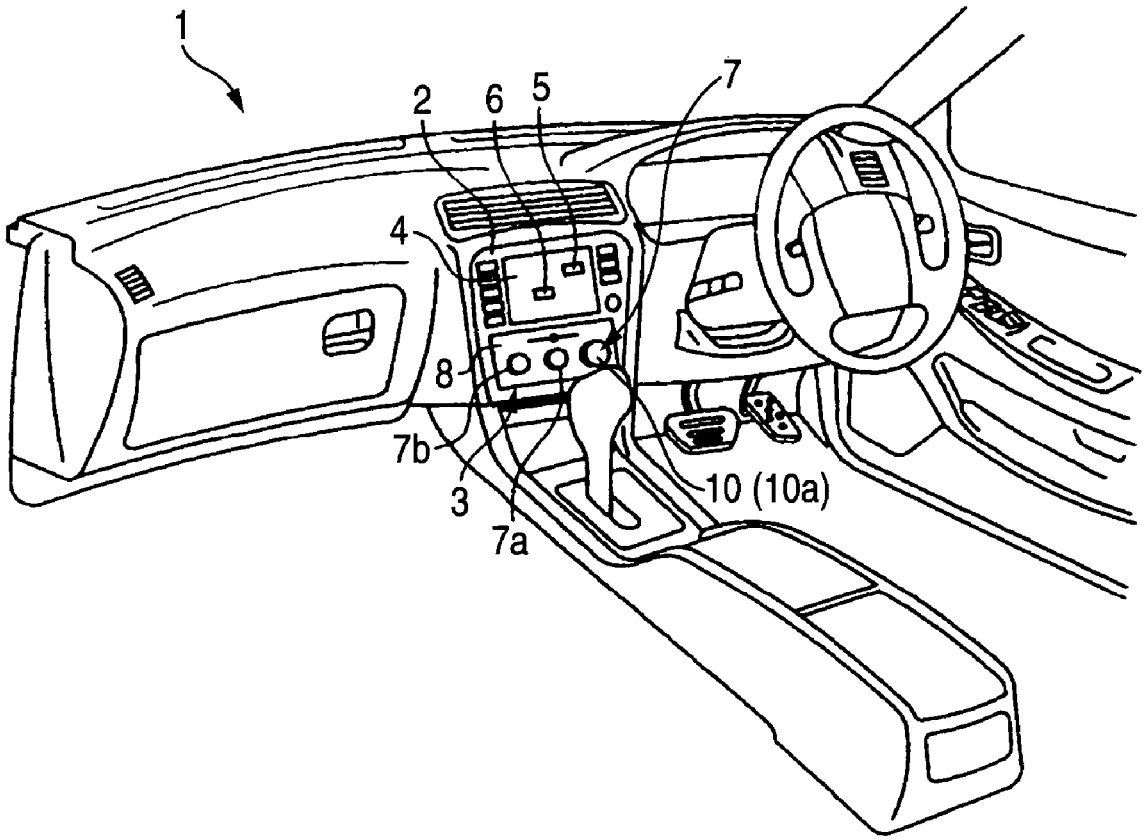
FIG. 1 is a perspective view of the interior of a vehicle according to one embodiment.

As shown in FIG. 1, on a center cluster 2 of a vehicle 1, an operating switch apparatus 3 is mounted as an operation system of various vehicle loaded equipment such as an air conditioning device, an audio device and a car navigation device. The operating switch 3 of this embodiment uses a graphical user interface (GUI) for enhancing visibility and operability at the time of performing a button selection operation. The graphical-user-interface-type operating switch apparatus 3 performs a graphic display of item buttons 5, icons 6 and the like on a display 4 mounted on the center cluster 2 and, while selectively designating the item buttons 5, the icons 6 or the like on the display 4 using an operating switch 7 mounted on the same center cluster 2, performs an input operation using a decision switch 7*a* and a return switch 7*b* arranged close to the operating switch 7.

Figure 3:
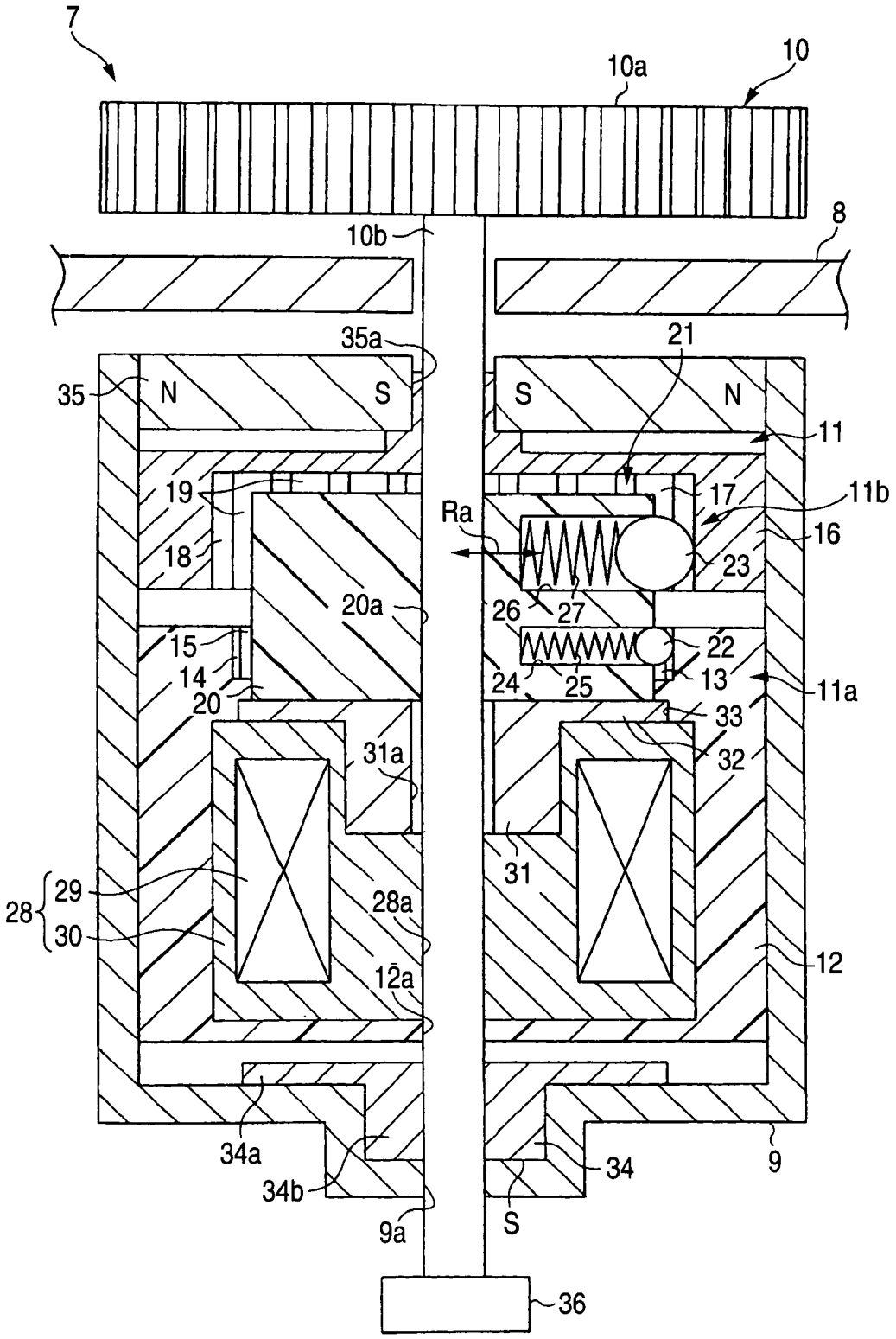
FIG. 3 is a longitudinal cross-sectional view showing the inner arrangement of an operating switch having a detent changeover mechanism.

As shown in FIG. 3, on an inner side of a cluster panel 8 of the center cluster 2, a yoke 9 constituting a switch casing for housing various kinds of switching parts such as the operating switch 7 is fixedly mounted. The yoke 9 is formed in a cylindrical shape with an upper portion thereof opened, for example, and is made of a magnetic material as a material thereof in this embodiment. When the operating switch 7 is of a dial operation type, a dial knob 10 which forms an operating portion at the time of operating the operating switch 7 is mounted on the yoke 9 in a rotatably operable state. The dial knob 10 is constituted of an approximately cylindrical knob portion 10*a* forming a grip portion at the time of operating the operating switch 7 and a shaft 10*b* extending integrally from a bottom surface of the knob portion 10*a* in the vertical direction at a coaxial position. The shaft 10*b* extends outwardly through a through hole 9*a* formed in a bottom wall of the yoke 9 in a penetrating manner in a state that the shaft 10*b* is rotatably operable. Here, the yoke 9 corresponds to a housing and the dial knob 10 corresponds to an operating portion.

Figure 4:
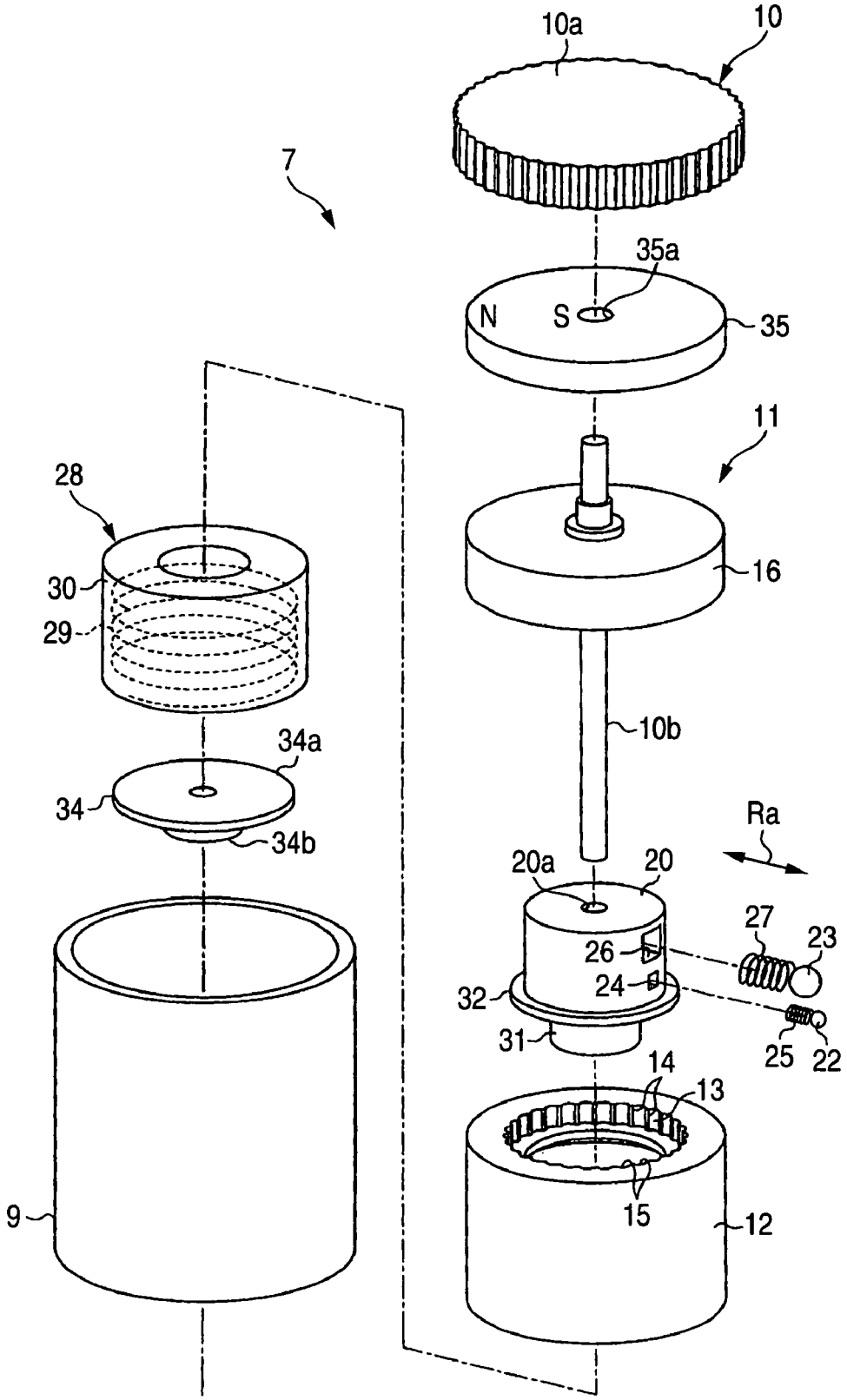
FIG. 4 is a decomposed perspective view showing a part group of the operating switch having the detent changeover mechanism.
Figure 5:
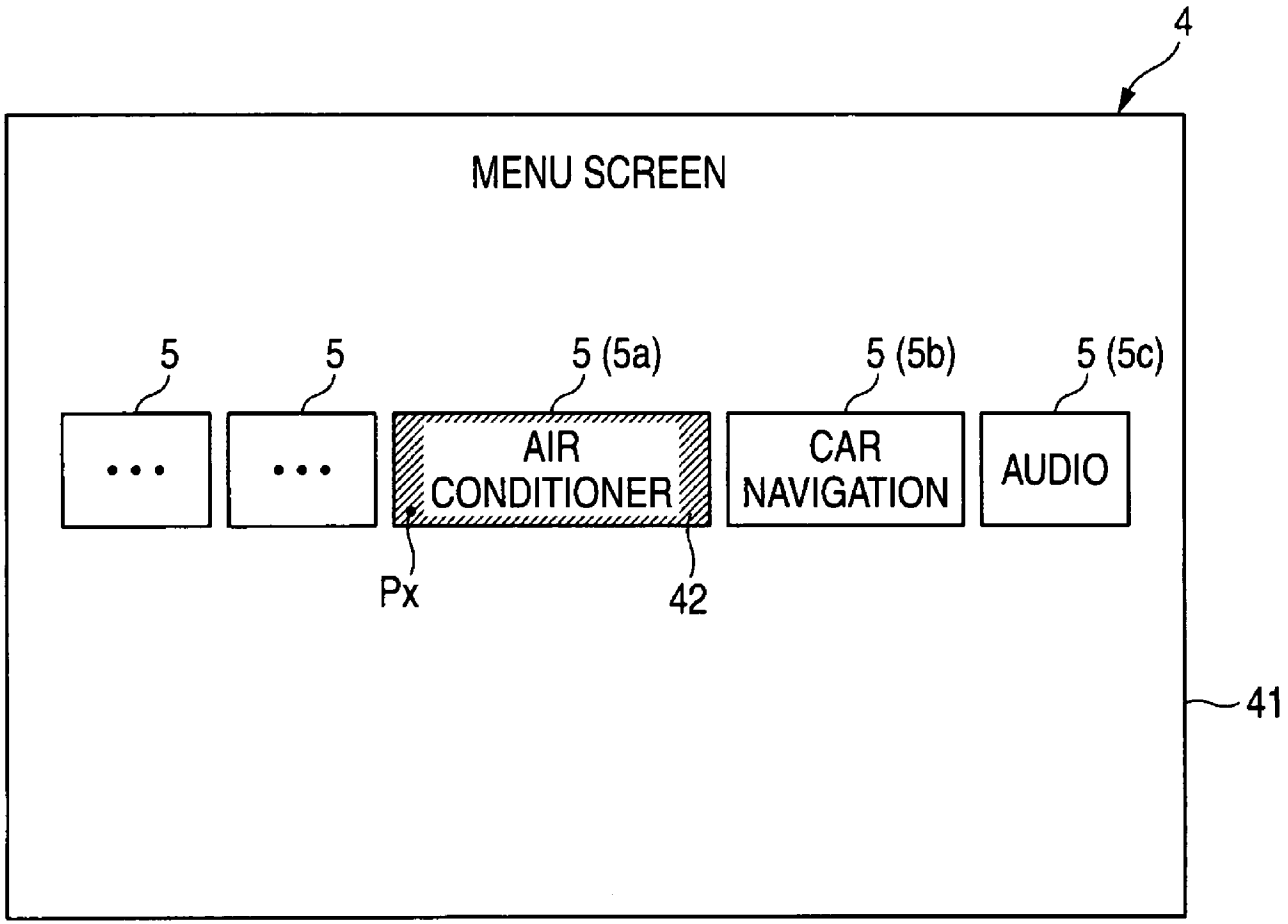
FIG. 5 is a screen view of a menu screen displayed on a display.

As shown in FIG. 3 and FIG. 4, in the inside of the yoke 9, a multi-stage detent mechanism 11 capable of generating click feelings in multiple stages in the dial knob 10 when the dial knob 10 is rotatably operated is arranged. The multi-stage detent mechanism 11 of this embodiment is a mechanism capable of changing the click feeling of the dial knob 10 among three states consisting of a small click generating state which generates small click (many click feelings) of the dial knob 10, a large click generating state which generates large click (few click feelings) of the dial knob 10, and a dial knob fixed state which stops the rotational operation of the dial knob 10, that is, fixes the dial knob 10.

To explain the multi-stage detent mechanism 11 hereinafter, in the inside of the yoke 9, a small click generating member 12 operable for allowing the dial knob 10 to generate a small click is fixedly mounted on an inner peripheral surface of the yoke 9. The small click generating member 12 is made of resin, for example, formed in a cylindrical shape with an upper end thereof opened, and is always fixed to the yoke 9. On an inner peripheral surface of an opening portion of the small click generating member 12, a small click uneven pattern 13 formed of a plurality of valleys and crests is formed. The small click uneven pattern 13 assumes a shape pattern in which a plurality of detent crests 14 and a plurality of detent valleys 15 are alternately arranged along the rotary operating direction of the dial knob 10, and a projecting quantity of detent crests 14 is set to a small value. A planar circular through hole 12*a* is formed in the small click generating member 12 at a center position of the small click generating member 12, and the shaft 10*b* is rotatably inserted into the through hole 12*a*. The small click generating member 12 corresponds to a support member and the small click uneven pattern 13 constitutes to a detent crest member.

On the other hand, at a knob-portion-side position of the shaft 10*b*, a large click generating member 16 operable for allowing the dial knob 10 to generate a large click is fixedly mounted on the shaft 10*b* in a state that the large click generating member 16 is integrally rotatable with the shaft 10*b*. The large click generating member 16 is made of resin, for example, formed in a bottomless cylindrical shape with a bottom surface side thereof opened, and is arranged coaxially with the shaft 10*b*. On an inner peripheral surface of the large click generating member 16, in the same manner as the small click generating member 12, a large click uneven pattern 17 formed of a plurality of valleys and crests is formed. The large click uneven pattern 17 sets a height of the detent crests 18 thereof relative to detent valleys 19 thereof higher than a height of the detent crests 14 of the small click uneven pattern relative to the detent valleys 15 and, at the same time, sets an interval of the detent crests 18 larger than an interval of the detent crests 14 of the small click uneven pattern 13. Here, the large click generating member 16 corresponds to an interlocking member and the large click uneven pattern 17 constitutes the detent crest member.

To the shaft 10*b*, a plunger case 20 made of a resin, for example, and formed in an approximately cylindrical shape is connected in a relatively rotatable manner. The plunger case 20 assumes a mounting state in which the plunger case 20 is arranged in an accommodating space 21 (see FIG. 3) defined between an opening portion of the small click generating member 12 and a recessed portion of the large click generating member 16. A planar circular-cross-sectional through hole 20*a* is formed in a central portion of the plunger case 20 in a penetrating manner, and the shaft 10*b* is inserted into the through hole 20*a* in a relatively rotatable manner.

A small click piece 22 which functions as a small click generating part and a large click piece 23 which functions as a large click generating part are mounted on the plunger case 20. A first accommodating portion 24 opening toward the small click uneven pattern 13 is formed in a side portion of the plunger case 20 at a position opposite to the knob portion. The small click piece 22 which functions as the small click generating part is accommodated in the first accommodating portion 24 in a state that the small click piece 22 is relatively movable in the biasing direction (the shaft orthogonal direction in this embodiment: direction indicated by an arrow Ra in FIG. 4) due to a biasing force of a first biasing member 25 and is brought into resilient contact with the small click uneven pattern 13. Here, the plunger case 20 corresponds to a mounting member and the small click piece 22 and the large click piece 23 constitute piece parts.

On the other side, a second accommodating portion 26 opening toward the large click uneven pattern 17 is formed in a side portion of the plunger case 20 at a position close to the knob portion. The large click piece 23 which functions as the large click generating part is accommodated in the second accommodating portion 26 in a state that the large click piece 23 is relatively movable in the biasing direction (the shaft orthogonal direction in this embodiment: direction indicated by an arrow Ra in FIG. 4) due to a biasing force of a second biasing member 27 and is brought into resilient contact with the large click uneven pattern 17. Here, in this embodiment, the detent mechanism constituted of the small click uneven pattern 13 and the small detent part group such as small click piece 22 form the first-stage detent mechanism 11*a*, and the detent mechanism constituted of the large click uneven pattern 17 and the large detent part group such as large click piece form the second-stage detent mechanism 11*b*.

In the inside of the small click generating member 12, a coil member 28 capable of generating a coil magnetic field in the surrounding thereof is fixedly mounted in a state that the coil member 28 is accommodated in the inside of the small click generating member 12. The coil member 28 is constituted of a coil 29 formed by winding a copper spring or the like, for example, a large number of times and a coil magnetic body 30 made of a magnetic material such as iron or nickel and forming a portion around which the coil 29 is wound. Further, the coil member 28 is always fixed to the small click generating member 12, that is, to the yoke 9. A planar circular cross-sectional through hole 28*a* is formed in the coil member 28 at a center position of the coil member 28, and the shaft 10*b* is inserted into the through hole 28*a* in a relatively rotatable manner. The coil 29 has the winding direction of winding thereof arranged about an axis of the shaft 10*b* and, at the same time, generates a coil magnetic field Hb (see FIG. 7A to FIG. 9) in the inside of the operating switch 7 when an electric current is supplied thereto.

On a bottom surface of the plunger case 20, a plunger magnetic body 31 made of a magnetic material such as iron or nickel, for example, is fixedly mounted in a state that the plunger magnetic body 31 is integrally rotatable with the plunger case 20. The plunger magnetic body 31 is arranged at a position where the plunger magnetic body 31 is in contact with the coil member 28. When electricity is supplied to the coil member 28 and a magnetic field is generated, the plunger magnetic body 31 is attracted to the coil member 28 by this magnetic field thus restricting the rotational operation of the plunger case 20. A planar circular cross-sectional through hole 31*a* is formed in the plunger magnetic body 31 at a center position of the plunger magnetic body 31, and the shaft 10*b* is inserted into the through hole 31*a* in a relatively rotatable manner. On a side portion of the plunger magnetic body 31, a removal preventing member 32 is mounted in a projecting manner over a whole rotational operation direction area of the dial knob 10. By engaging the removal preventing member 32 with a groove portion 33 (see FIG. 3) defined between the small click generating member 12 and the coil member 28 in a relatively rotatable manner, the removal of the plunger case 20 can be prevented. Here, the coil 29 corresponds to an electromagnet and the plunger magnetic body 31 corresponds to a magnetic body.

On an end portion of the shaft 10*b* on a side opposite to the dial knob 10, a shaft magnetic body 34 made of a magnetic material such as iron or nickel, for example, is fixedly mounted in a state that the shaft magnetic body 34 is integrally rotatable with the shaft 10*b*. The shaft magnetic body 34 is mounted coaxially with the shaft 10*b* and assumes a mounting state where the shaft magnetic body 34 is in contact with an inner-wall bottom surface of the yoke 9. The shaft magnetic body 34 is a member which is attracted to the yoke 9 when a strong magnetic force is generated in the yoke 9 so as to restrict the rotational operation of the shaft 10*b*. Accordingly, the shaft magnetic body 34 is configured to have stepped portions consisting of a large-diameter portion 34*a* and a small-diameter portion 34*b*. By forming the shaft magnetic body 34 in such a shape, a contact surface S between the shaft magnetic body 34 and the inner-wall bottom surface of the yoke 9 (see FIG. 3) can ensure a sufficient contact area. Here, the shaft magnetic body 34 corresponds to a magnetic attracting member.

Further, at an opening-end-portion position of the yoke 9, an approximately planar permanent magnet 35 is fixedly mounted so as to close the opening end portion of the yoke 9. The permanent magnet 35 is a magnet having a N pole on a radially outer side and an S pole on a center side and is formed using a magnetic material such as iron, nickel or cobalt as a material thereof, for example. A planar circular cross-sectional through hole 35*a* is formed in the permanent magnet 35 at a center position of the permanent magnet 35, and the shaft 10*b* is inserted into the through hole 35*a* in a relatively rotatable manner. With respect to a magnet magnetic field Ha of the permanent magnet 35 (see FIG. 7A to FIG. 9), the yoke 9, the shaft 10*b* and the shaft magnetic body 34 are made of the magnetic material and hence, these parts form a magnetic path when a magnetic field is generated. Here, the permanent magnet 35 corresponds to an auxiliary magnetic field generating member.

Here, the changeover of the click generated in the dial knob 10 of this embodiment includes the change of click feeling generated in the dial knob 10 when the dial knob 10 is rotatably operated and the change of click strength corresponding to an operation load when the dial knob 10 is rotatably operated in broad meaning. That is, the description "the click is increased" implies the increase of the click feeling or the click strength, while the description "the click is decreased" implies the decrease of the click feeling or the click strength. Further, a distance between the detent crests 14(18) positioned close to each other is mainly relevant to the change of click feeling, while a height of the detent crests 14(18), a size of the click piece 22(23), and a biasing force of the biasing member 25(27) are relevant to the change of click strength.

Figure 2:
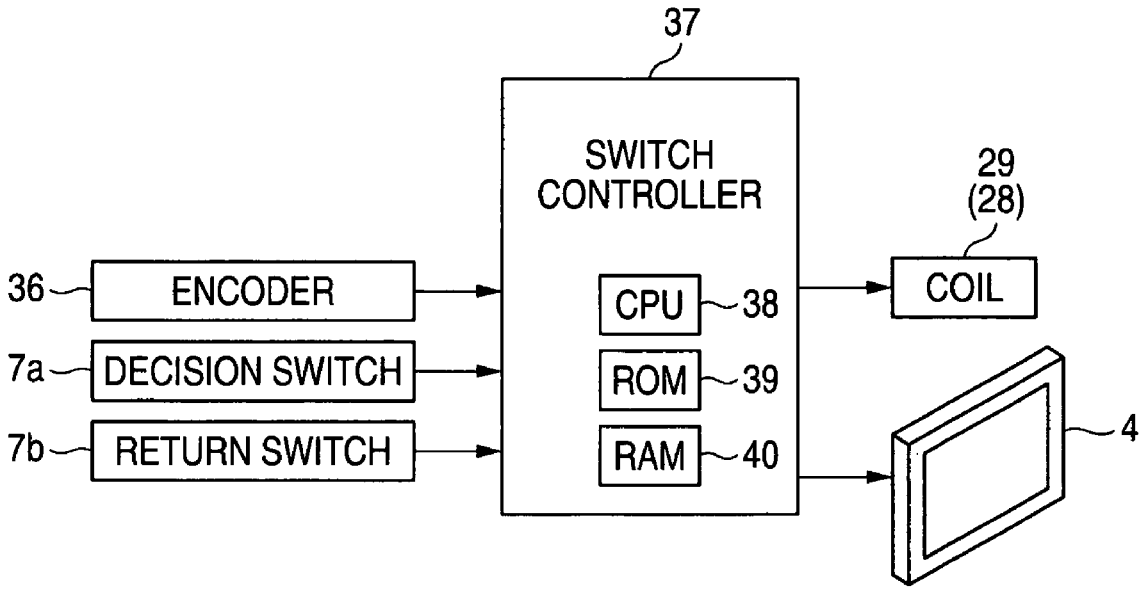
FIG. 2 is a schematic structure view showing the device arrangement of an operating switch apparatus.

As shown in FIG. 2 and FIG. 3, on a lower end of the operation shaft 10*b* of the dial knob 10, an encoder 36 for detecting a rotary quantity (rotational speed) of the dial knob 10 is mounted. The encoder 36 is constituted of a pulse encoder which outputs a rotation detection output value as pulse signals, for example. In detecting the rotation of the dial knob 10, the encoder 36 is capable of outputting a detection signal consisting of the number of pulses corresponding to the rotational quantity of the dial knob 10 at the point of time. Here, the decision switch 7*a*, the return switch 7*b* and the encoder 36 constitutes a detector.

As shown in FIG. 2, the operating switch apparatus 3 includes a switch controller 37 as a control unit for the operating switch apparatus 3. The switch controller 37 includes a CPU 38 for systematically controlling the switch controller 37, a ROM 39 for storing various programs and data groups, a RAM 40 used as an operational region at the time of performing a program operation and the like, and is operated in accordance with a control program in the inside of the ROM 39. The switch controller 37 is connected to the encoder 36 through electric wiring. The switch controller 37 calculates a rotational operation quantity of the dial knob 10 using the detection signal acquired from the encoder 36, and supplies the operation quantity information to other control units which require such a rotational operation quantity or performs a display control of a display screen of the display 4.

The switch controller 37 performs a changeover control of click feeling generated in the dial knob 10 such that an electricity supply state of the coil 29 is controlled based on various operations performed by an operator at the time of operating the dial knob 10 so as to change over the generation direction of a magnetic field generated by the coil 29 or the presence or non-presence of the generation of the magnetic field. That is, the switch controller 37 can bring the coil 29 into any one of the electricity supply states consisting of a non-electricity-supply state, a backward connection electricity supply state and a forward connection electricity supply state. Here, by making a coil magnetic field Hb generated by the coil 29 and a magnet magnetic field Ha generated by the permanent magnet 35 cooperatively function, the click feeling generated in the dial knob 10 is changed over among three states consisting of a small click generating state, a large click generating state and a fixed state. Here, the switch controller 37 corresponds to a controller.

Next, the manner of operation of the operating switch apparatus 3 of this embodiment is explained.

Figure 6:
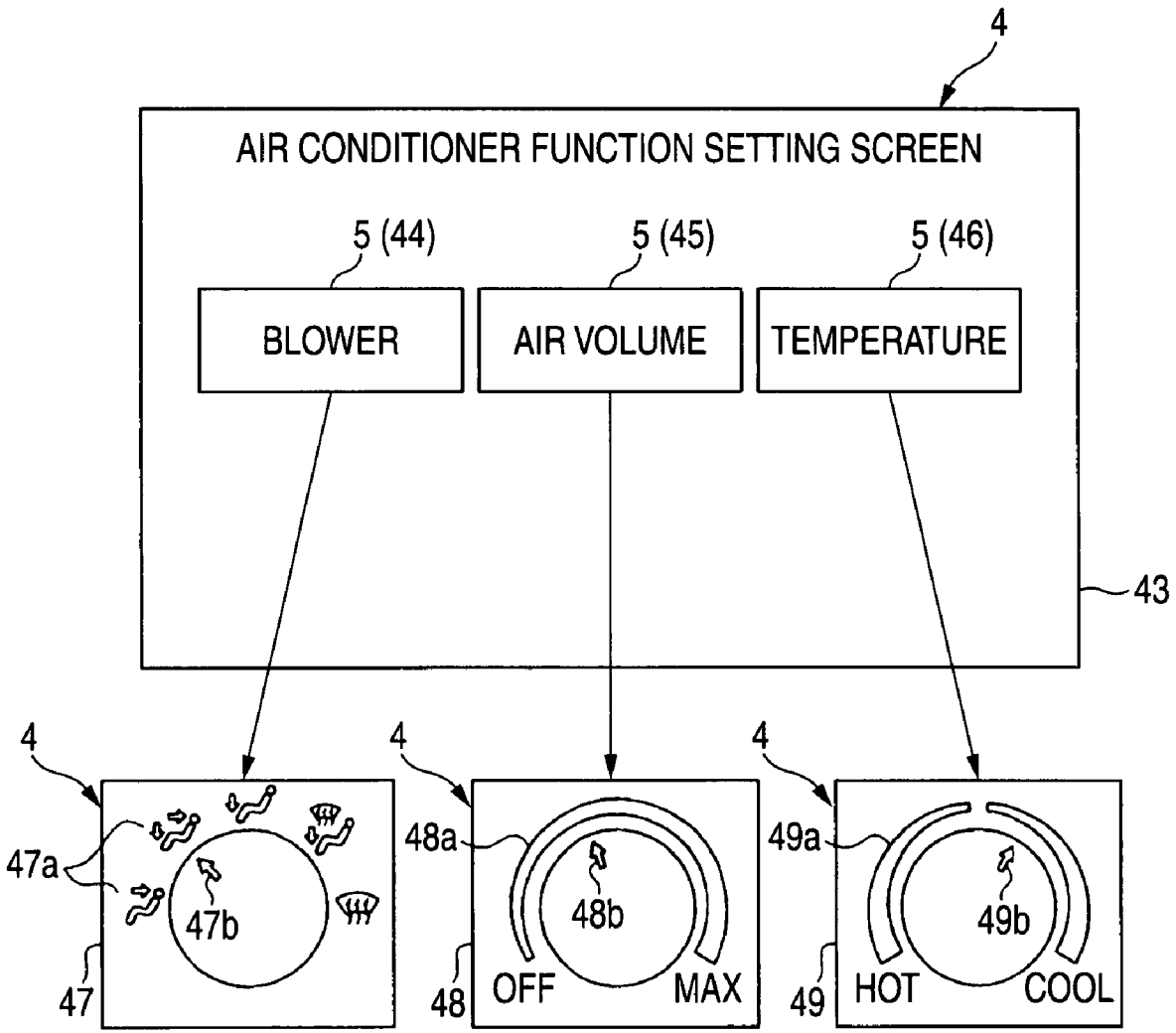
FIG. 6 is a screen view of an air conditioner function setting screen displayed on the display.

When an ignition switch (not shown in the drawing) of the vehicle I is operated to assume an ACC position or an IG position, the switch controller 37 assumes a start state and sets an operation mode thereof to an item button selection mode, displays a menu screen 41 shown in FIG. 6 as an initial operation screen on the display 4, and recognizes the operating switch 7 as an item button selection switch. On the menu screen 41, a plurality of item buttons 5, 5 . . . which is selectively designated at the time of setting functions of various vehicle equipment mounted on the vehicle 1 is displayed in an allocated manner As the item buttons 5, 5 . . . displayed on the menu screen 41, for example, an air conditioner function setting button 5*a* selected for setting the various functions of the air conditioner, a car navigation button 5*b* selected for setting various functions of the car navigation device, an audio button 5*c* selected for setting various functions of the audio device and the like are provided.

Here, in selecting and designating the item button 5 on the menu screen 41, a selection coordinate position Px on the display 4 is moved by the dial knob 10 so as to position the button focus 42 on the desired item button 5 and, after such positioning, the decision switch 7*a* (see FIG. I and FIG. 2) mounted on the center cluster 2 is operated by pushing. When the switch controller 37 recognizes the selection operation of the decision switch 7*a*, the switch controller 37 recognizes the item button 5 positioned at the selection coordinate position Px immediately before the decision switch 7*a* is operated as an operation demand button, and various processing corresponding to functions which the operation demand button possesses are performed with respect to the vehicle 1.

Here, in the operating switch apparatus 3 of this embodiment which uses one operating switch 7 in common among a plurality of selection functions, objects to be selected or items to be selected differ depending on the respective selection functions (including the display screen and the knob rotational operating position) and hence, it is preferable to cope with such a situation by changing the click strength generated in the dial knob 10 corresponding to the respective selection functions. Accordingly, the operating switch 7 of this embodiment includes the detent mechanism 11 capable of generating click feelings in multiple stages in the dial knob 10. In this type of detent mechanism 11, the generated click differs for every detent mechanism 11*a*, 11*b* and hence, this embodiment copes with the above-mentioned situation by bringing the desired detent mechanism 11*a*, 11*b* into a drive state at the time of operating the switch.

For example, when the menu screen 41 is displayed on the display 4 and the dial knob 10 is set to generate the small click, the switch controller 37, in displaying the menu screen 41 on the display 4, brings the coil 29 into a non-electricity-supply state together with the image display. Here, the operating switch 7 assumes a state shown in FIG. 7A where a magnetic circuit to which only the magnet magnetic field Ha generated by the permanent magnet 35 is applied is generated, and a magnetic path in which the magnet magnetic field Ha reaches the yoke 9, the shaft magnetic body 34 and the shaft 10*b* and returns to the permanent magnet 35 is established.

Figure 7A:
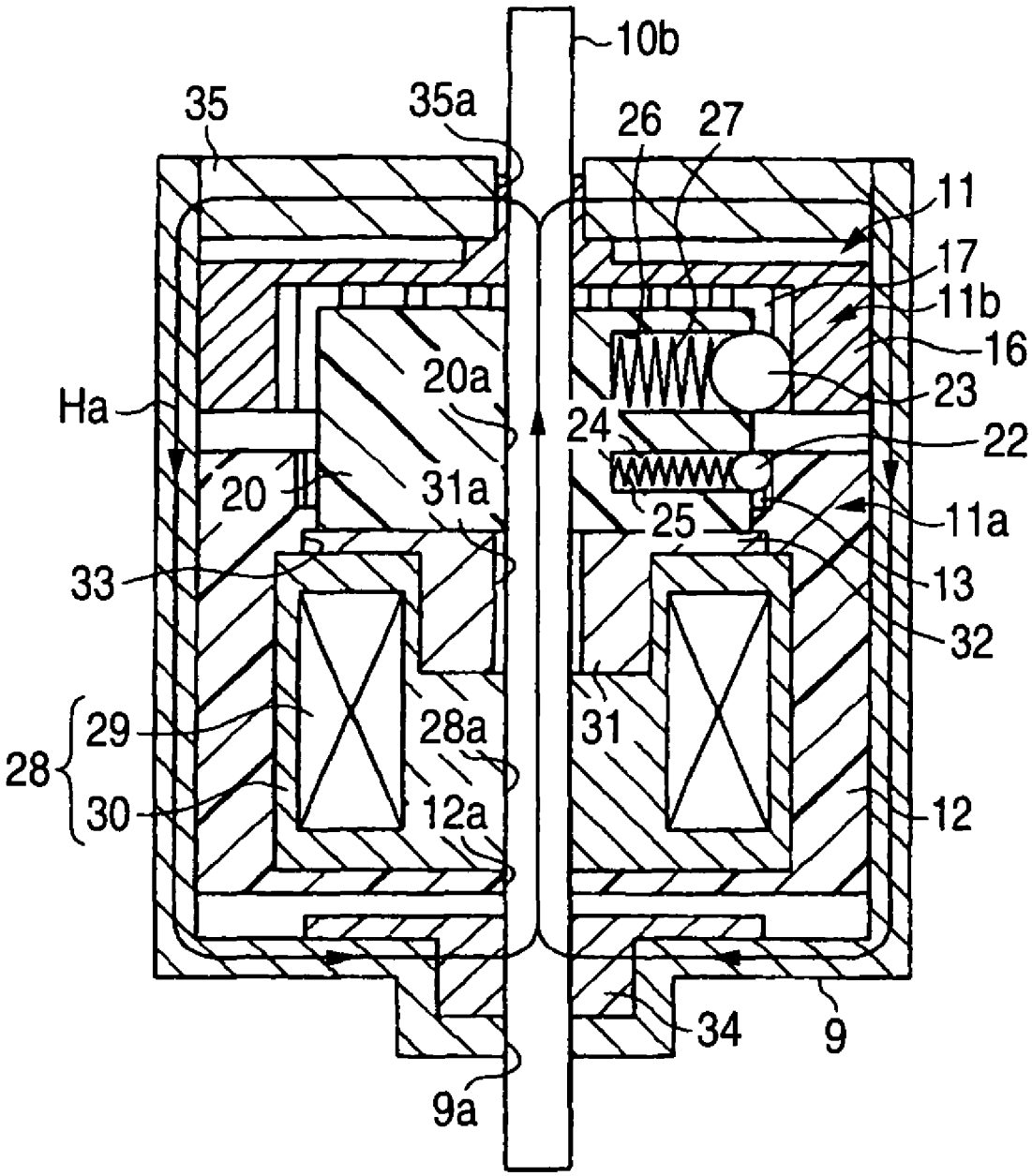
FIGS. 7A and 7B being explanatory views of an operation in generating small click in the operating switch.
Figure 7B:
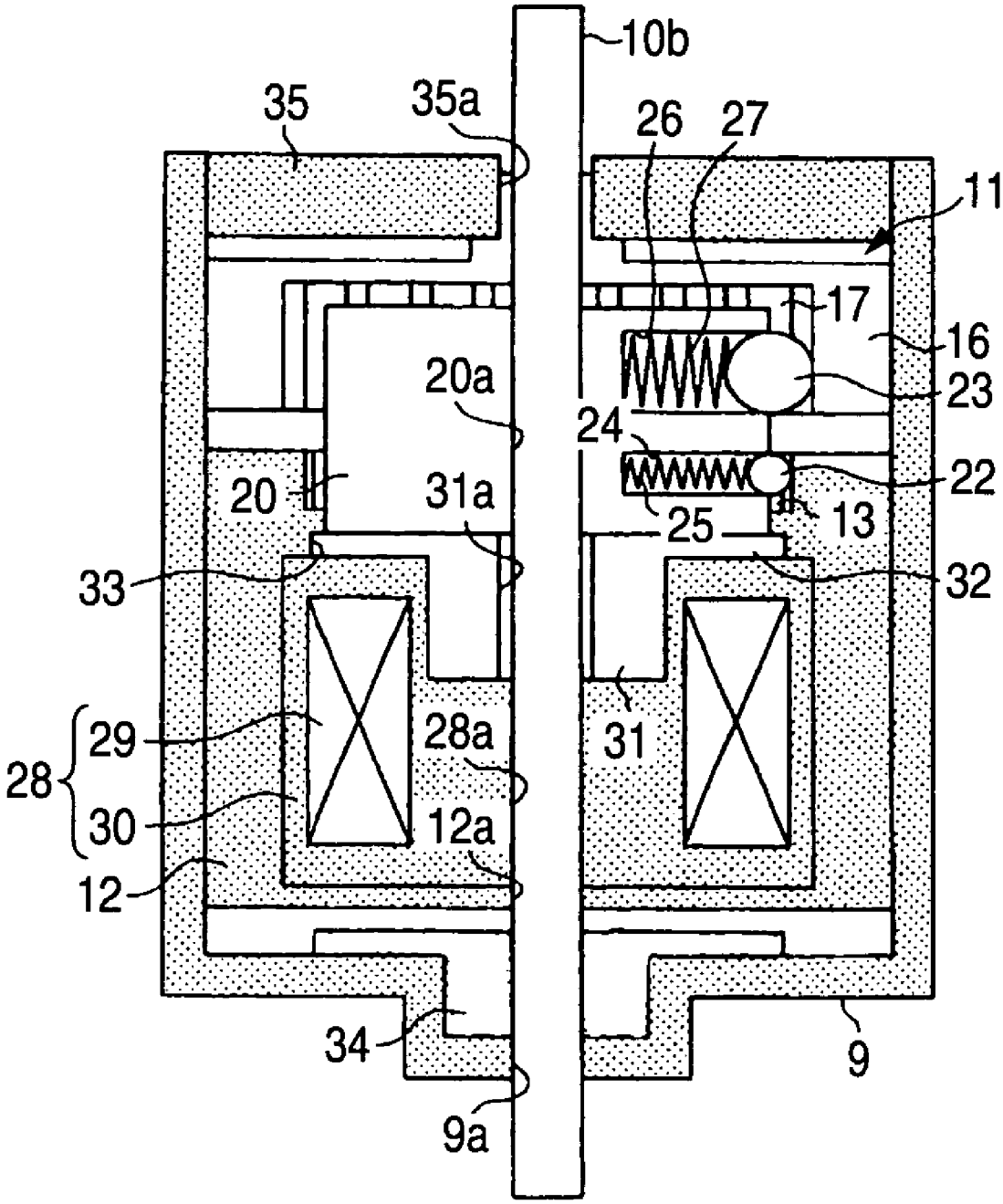

Here, when the electricity is not supplied to the coil 29, an attracting force attributed to the coil magnetic field Hb is generated on a contact surface S between the yoke 9 and the shaft magnetic body 34. However, the permanent magnet 35 is formed using a magnet which generates a weak magnetic field when used alone. Accordingly, in this case, although an attracting force attributed to the magnet magnetic field Ha is applied to the contact surface S, this attracting force is extremely weak and hence, the smooth rotational operation of the shaft 10*b* is allowed. Further, when the electricity is not supplied to the coil 29, the plunger magnetic body 31 is not attracted to the coil member 28 due to a magnetic force and hence, the rotational operation of the plunger case 20 relative to the yoke 9 is allowed. Accordingly, in this case, as shown in FIG. 7B, the part group consisting of the dial knob 10, the large click generating member 16, the plunger case 20 and the plunger magnetic body 31 forms a part group whose rotational operation is allowed and other parts form a part group (part group indicated by dots in FIGS. 7A and 7B) fixed to the yoke 9 side.

Further, the meshing resistance between the large click piece 23 and the large click uneven pattern 17 is set larger than the meshing resistance between the small click piece 22 and the small click uneven pattern 13 and hence, when the dial knob 10 is rotatably operated when the electricity is not supplied to the coil 29, the plunger case 20 (including the plunger magnetic body 31) is integrally rotated with the dial knob 10 (shaft 10*b*). Accordingly, along with the rotational operation of the dial knob 10, the small click piece 22 takes an action to sequentially get over the detent crests 14 of the small click uneven pattern 13 and hence, the first-stage detent mechanism 11*a* is brought into a drive state whereby the click feeling with small click which the first-stage detent mechanism 11*a* possesses is generated in the dial knob 10.

Figure 8A:
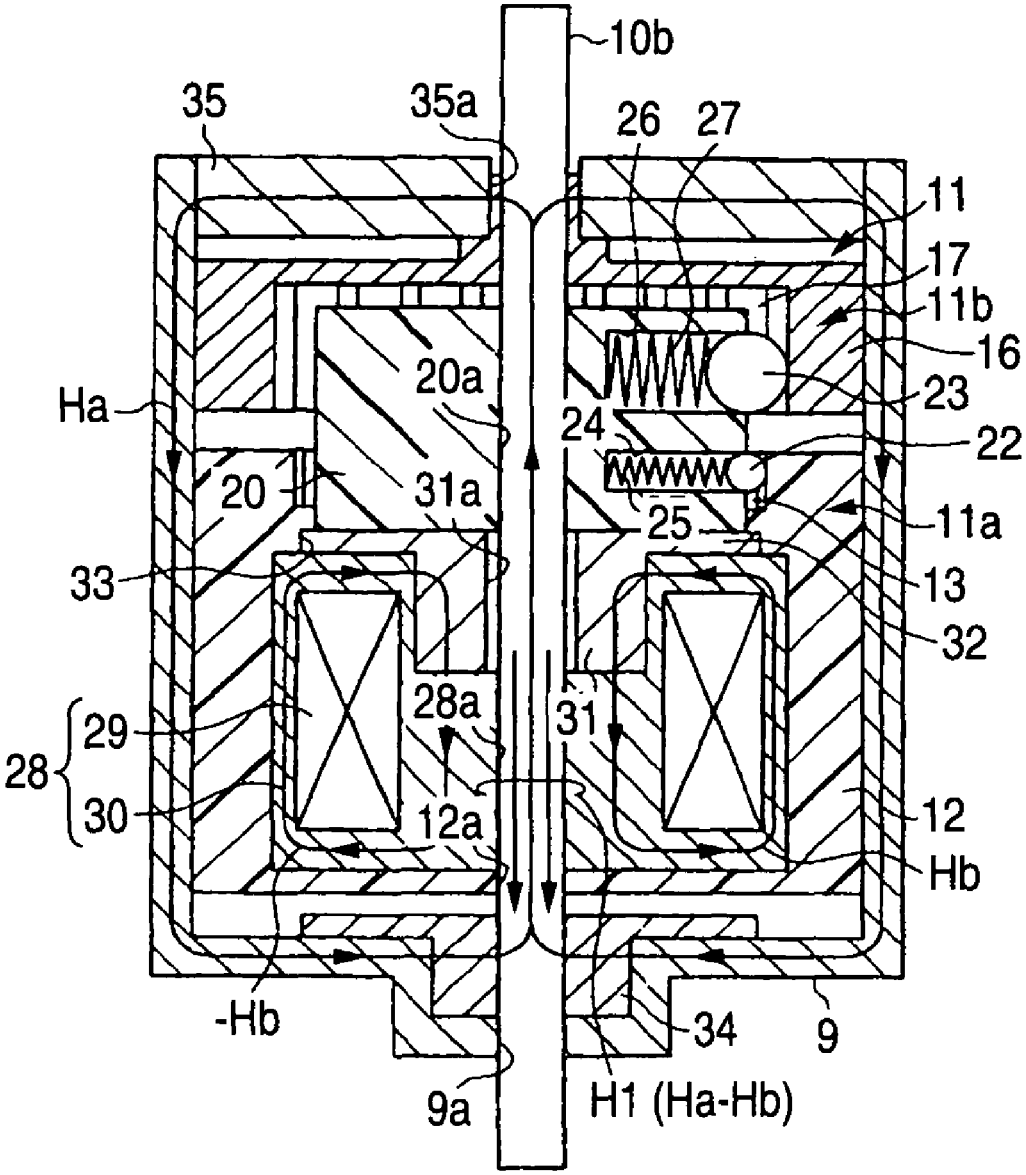
FIGS. 8A and 8B being explanatory views of an operation in generating large click in the operating switch.

On the other hand, when the menu screen 41 is displayed on the display 4 and the dial knob 10 is set to generate the large click, the switch controller 37, in displaying the menu screen 41 on the display 4, brings the coil 29 into a backward connection electricity supply state together with the image display. The "backward connection electricity supply" described here implies a phenomenon in which the electricity is supplied to the coil 29 such that the coil magnetic field Hb generated in the coil 29 when the electricity is supplied to the coil 29 is directed opposite to the direction of the magnet magnetic field Ha of the permanent magnet 35. In this case, as shown in FIG. 8A, the coil magnetic field Hb having the magnetic field direction opposite to the magnetic field direction of the magnet magnetic field Ha is generated in the coil 29. Accordingly, at this point of time, in the operating switch 7, a magnetic circuit which generates a subtracted magnetic filed H1 obtained by subtracting the coil magnetic field Hb from the magnet magnetic field Ha of the permanent magnet 35 is generated, and this subtracted magnetic filed H1 is applied to the contact surface S.

Figure 8B:
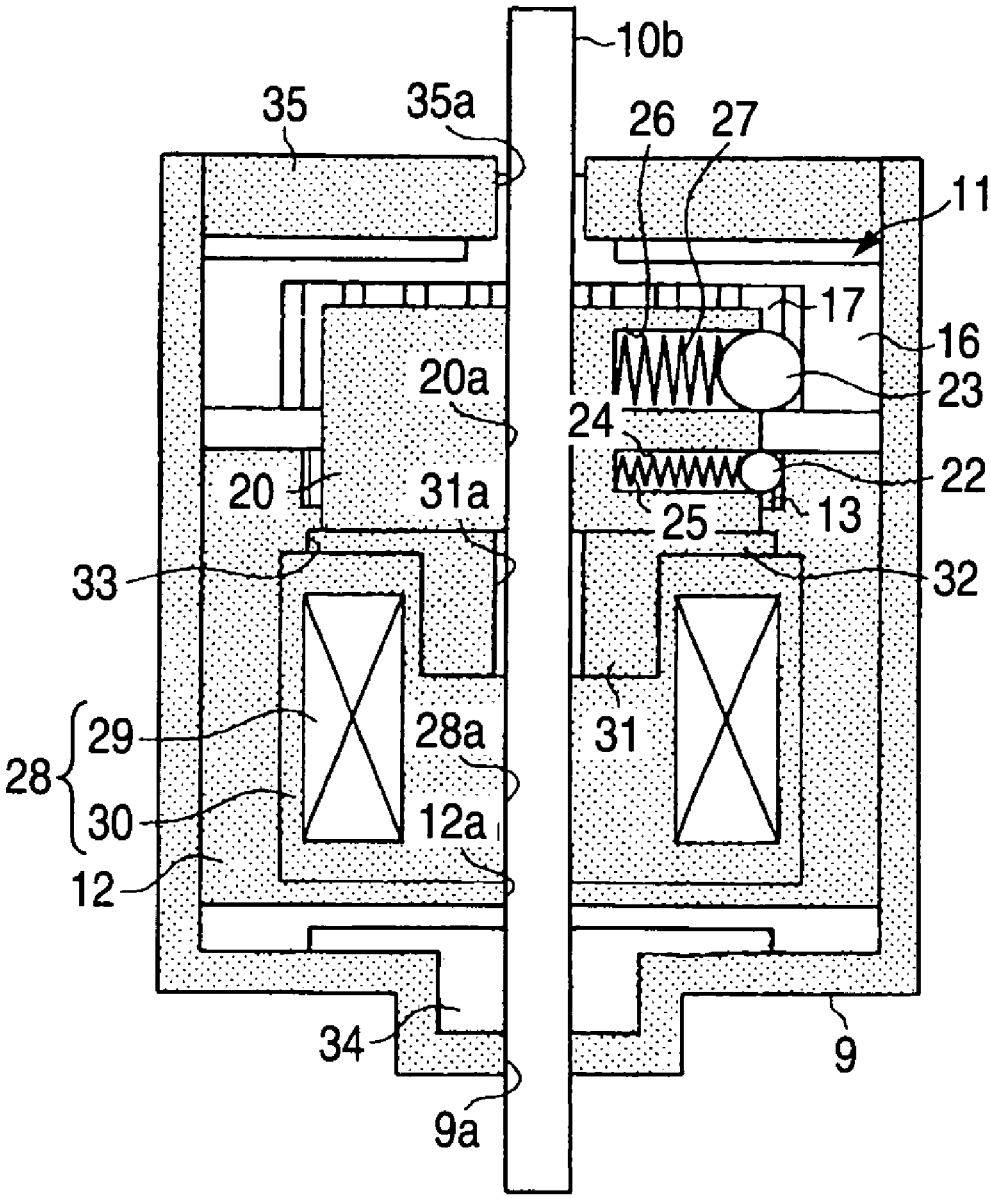

Here, also at this point of time, an attracting force attributed to the magnetic field generation is applied to the contact surface S. However, at this point of time, the generated magnetic field on the contact surface S is the subtracted magnetic filed H1 of low magnetic field strength obtained by subtracting the coil magnetic field Hb of the coil 29 from the magnet magnetic field Ha of the permanent magnet 35. Accordingly, although the attracting force attributed to the magnetic field generation is generated on the contact surface S also at this point of time, the attracting force is extremely weak and hence, the smooth rotational operation of the shaft 10*b* is allowed. Further, when the coil 29 assumes an electricity-supply state (here, backward connection electricity supply state), the plunger magnetic body 31 is attracted to the coil member 28 due to the magnetic force of the plunger magnetic body 31 and hence, the plunger case 20 is fixed to the yoke 9 side. Accordingly, in this case, as shown in FIG. 8B, the part group consisting of the dial knob 10 and the large click generating member 16 forms a part group whose rotational operation is allowed and other parts form a part group (part group indicated by dots in FIG. 8B) constitute a part group fixed to the yoke 9 side.

Accordingly, when the dial knob 10 is rotatably operated due to the supply of electricity by the backward connection electricity supply, along with such a rotational operation, the large click generating member 16 performs a rotation relative to the plunger case 20. Accordingly, along with the rotational operation of the dial knob 10, the large click piece 23 takes an action to sequentially get over the detent crests 18 of the large click uneven pattern 17 and hence, the second-stage detent mechanism 11*b* is brought into a drive state whereby the click feeling with large click which the second-stage detent mechanism 11*b* possesses is generated in the dial knob 10.

When the selection and decision operations of the air conditioner function setting button 5*a* is performed on the menu screen 41, the switch controller 37 sets an operation mode thereof to an air conditioner function setting mode, and displays an air conditioner function setting screen 43 shown in FIG. 6 as a detailed function setting screen of the air conditioner on the display 4 and, at the same time, recognizes the operating switch 7 as an air conditioner function switch. On this air conditioner function setting screen 43, a blower button 44 selected at the time of changing over an air blow-off port, an air volume setting button 45 selected at the time of setting an air volume, and a supply-air temperature setting button 46 selected at the time of setting a supply-air temperature of air are allocated. Here, the selection and decision operation of these buttons 44 to 46 is performed in the same manner at the time of selecting and deciding the item buttons 5 on the menu screen 41, and the click generated by the dial knob 10 is set to either one of large and small clicks.

When the blower button 44 is selected and designated on the air conditioner function setting screen 43, the switch controller 37 which detects the button selection and decision operation sets the operation mode thereof to a blower function setting mode, and displays the blower setting screen 47 shown in FIG. 6 on the display 4 and, at the same time, recognizes the operating switch 7 as a blower function setting switch. On the blower setting screen 47, blower function images 47*a*, 47*a* . . . corresponding to the respective blower functions are displayed as images. Here, the blower function in a selected state is notified to a user by a designation display which designates the blower function image 47*a* on the screen with an arrow 47*b*. Here, when the selection state of the blower function is changed over due to the rotational operation of the dial knob 10, the display position of the arrow 47*b* on the blower setting screen 47 is also changed over and displayed corresponding to the blower function position after the selection and the designation.

When the air volume setting button 45 is selected and designated on the air conditioner function setting screen 43, the switch controller 37 which detects the button selection and decision operation sets the operation mode thereof to an air volume setting mode, and displays an air volume setting screen 48 shown in FIG. 6 on the display 4 and, at the same time, recognizes the operating switch 7 as an air volume setting switch. On the air volume setting screen 48, an air volume image 48*a* imaging an air volume is displayed as an image. Here, the air volume in a selected state is notified to a user by a designation display which designates the air volume image 48*a* on the screen with an arrow 48*b* at a set air volume position. Here, when the selection state of the air volume is changed over due to the rotational operation of the dial knob 10, the display position of the arrow 48*b* on the air volume setting screen 48 is also changed over and displayed corresponding to the air volume after the selection and the designation.

When the supply-air temperature setting button 46 is selected and designated on the air conditioner function setting screen 43, the switch controller 37 which detects the button selection and decision operation sets the operation mode thereof to a supply-air temperature setting mode, and displays an supply-air temperature setting screen 49 shown in FIG. 6 on the display 4 and, at the same time, recognizes the operating switch 7 as a supply-air temperature setting switch. On the supply-air temperature setting screen 49, a supply-air temperature image 49*a* imaging a supply-air temperature is displayed as an image. Here, the supply-air temperature in a selected state is notified to a user by a designation display which designates the supply-air temperature image 49*a* on the screen with an arrow 49*b* at the supply-air temperature setting position. Here, when the selection state of the supply-air temperature is changed over due to the rotational operation of the dial knob 10, the display position of the arrow 49*b* on the supply-air temperature setting screen 49 is also changed over and displayed corresponding to the supply-air temperature after the selection and the designation.

The switch controller 37, in displaying the various screens 47 to 49 on the display 4, sets the click feeling generated in the dial knob 10 to click strengths corresponding to these screens 47 to 49. Further, for example, the number of selection items is relatively small with respect to such kinds of blower functions and hence, in displaying the blower setting screen 47 on the display 4, the small click is generated in the dial knob 10 by bringing the first-stage detent mechanism 11*a* into a drive state. In this case, each time the blower function is changed over from one function to the neighboring function, the dial knob 10 is brought into a state in which the dial knob 10 generates operation feeling of one click so that the number of the blower selection function stages corresponds to the number of clicks of the dial knob 10. Further, the number of selections items of the air volume setting function and the number of selections items of the supply-air temperature setting function are larger than the number of selection items of the blower functions. Accordingly, in such a situation, the second-stage detent mechanism 11*b* is brought into a drive state to cope with the situation.

Figure 9A:
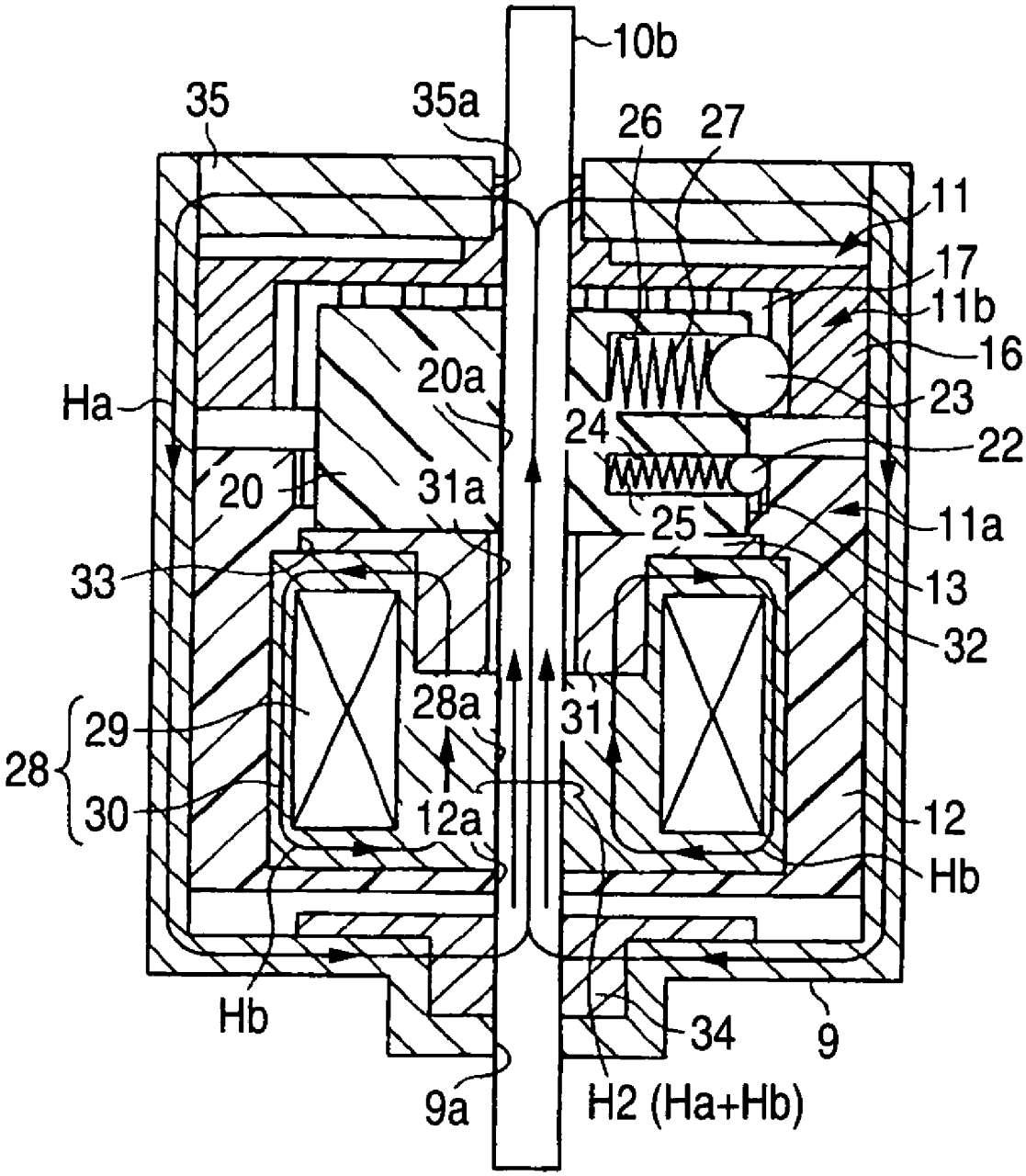
FIGS. 9A and 9B being explanatory views of an operation in fixing the operating switch.

Further, when the display screen of the display 4 becomes a screen which prohibits the rotational operation of the dial knob 10, the switch controller 37, in displaying this kind of display screen on the display 4, brings the coil 29 into a forward connection electricity supply state along with this image display. Here, the "forward connection electricity supply" described here implies a phenomenon in which the electricity is supplied to the coil 29 such that the coil magnetic field Hb generated in the coil 29 when the electricity is supplied to the coil 29 is directed in the same direction as the magnet magnetic field Ha of the permanent magnet 35. The forward connection electricity supply is executed by supplying the same quantity of electric current having the direction opposite to the direction of the electric current in the backward connection electricity supply. Accordingly, at this point of time, in the operating switch 7, as shown in FIG. 9A, a magnetic circuit which generates a resultant magnetic filed H2 obtained by combining the frontward-connection coil magnetic field Hb which the coil 29 generates and the magnet magnetic field Ha of the permanent magnet 35 is generated, and this resultant magnetic filed H2 is applied to the contact surface S.

Figure 9B:
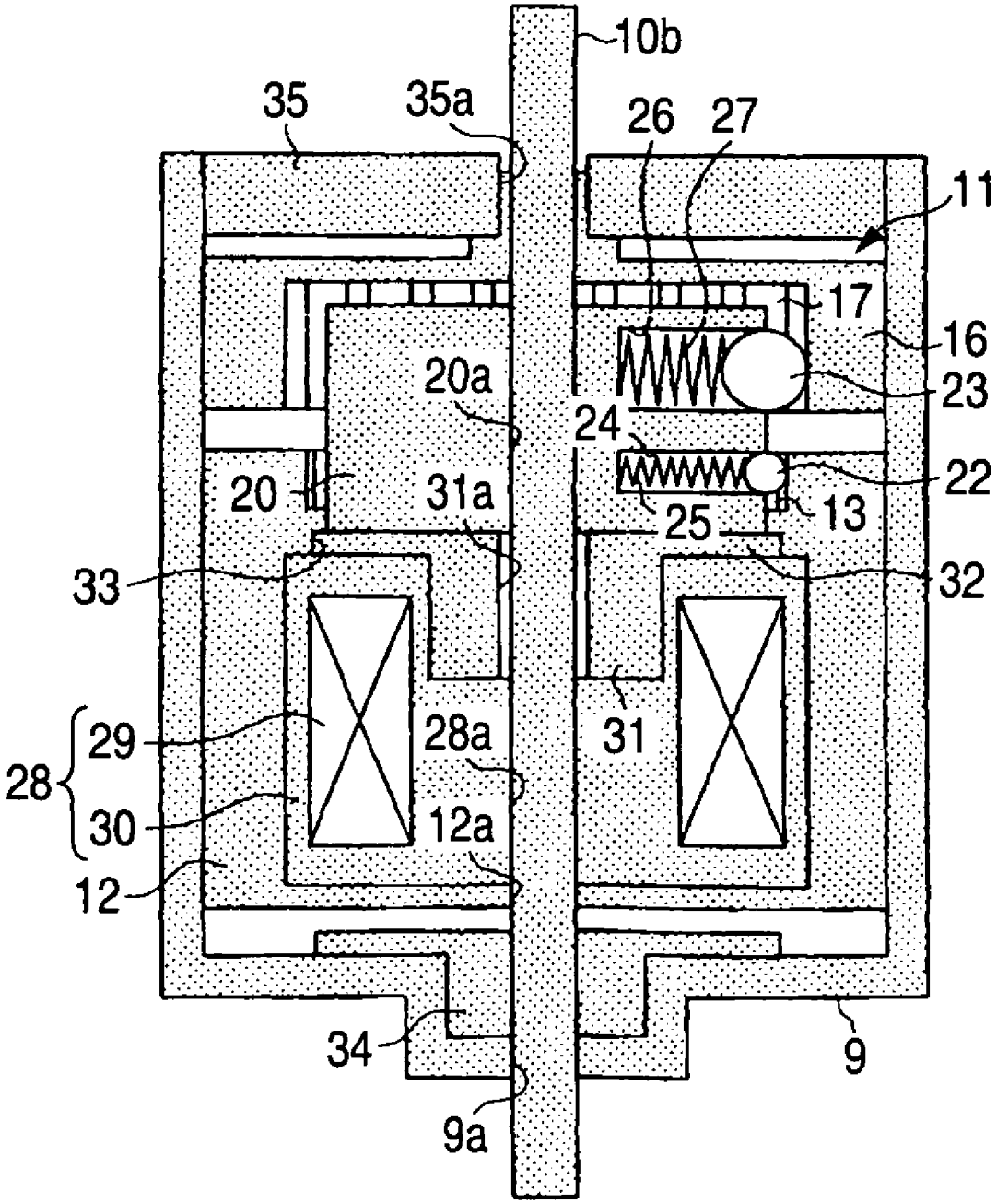

Accordingly, when electricity is supplied to the coil 29 in a forward connection electricity supply state, an extremely strong magnetic field which is the resultant magnetic filed H2 acquired by superposing the frontward-connection coil magnetic field Hb which the coil 29 generates and the magnet magnetic field Ha of the permanent magnet 35 is generated on the contact surface S and hence, the shaft magnetic body 34 is strongly attracted to the yoke 9 with an extremely strong force generated by the resultant magnetic filed H2 whereby the dial knob 10 is fixed to the yoke 9. Accordingly, as shown in FIG. 9B, almost all parts including the dial knob 10 constitute a part group fixed to the yoke 9 side (part group indicated by dots in FIG. 9B). Due to such a arrangement, even in an attempt to rotatably operate the dial knob 10 when the electricity is supplied to the coil 29 in the forward connection, since the dial knob 10 is fixed to the yoke 9 at this point of time, the dial knob 10 cannot be rotatably operated whereby the operation of the operating switch 7 is inhibited.

Further, the general-type blower function setting switch is often a rotational-operation-range limited switch with a dial knob portion rotatable only within a predetermined range. When the operating switch 7 of this embodiment is used for setting the blower function, in view of a use mode in general, it is preferable to impose a rotational operation limit to the operating switch 7. Accordingly, the switch controller 37 recognizes the blower function arranged at one-end position in the rotary operating direction of the dial knob 10 (front-surface blow-off port) and the blower function arranged at another-end position in the rotary operating direction of the dial knob 10 (dehumidifying function direction) as a dial knob stop position, and stops the further rotational operation of the dial knob 10 when the dial knob 10 is positioned at these dial knob stop positions.

That is, the switch controller 37, when the dial knob 10 is positioned at these dial knob stop positions, supplies electricity to the coil 29 in forward connection at this timing and hence, the dial knob 10 is fixed thus inhibiting the rotational operation of the dial knob 10. Accordingly, the further rotational operation of the dial knob 10 is prevented and hence, the operating switch 7 also functions as a rotational operation range limiting switch. Further, the same goes for the operation of the air volume setting system or the supply-air temperature setting system.

Figure 10:
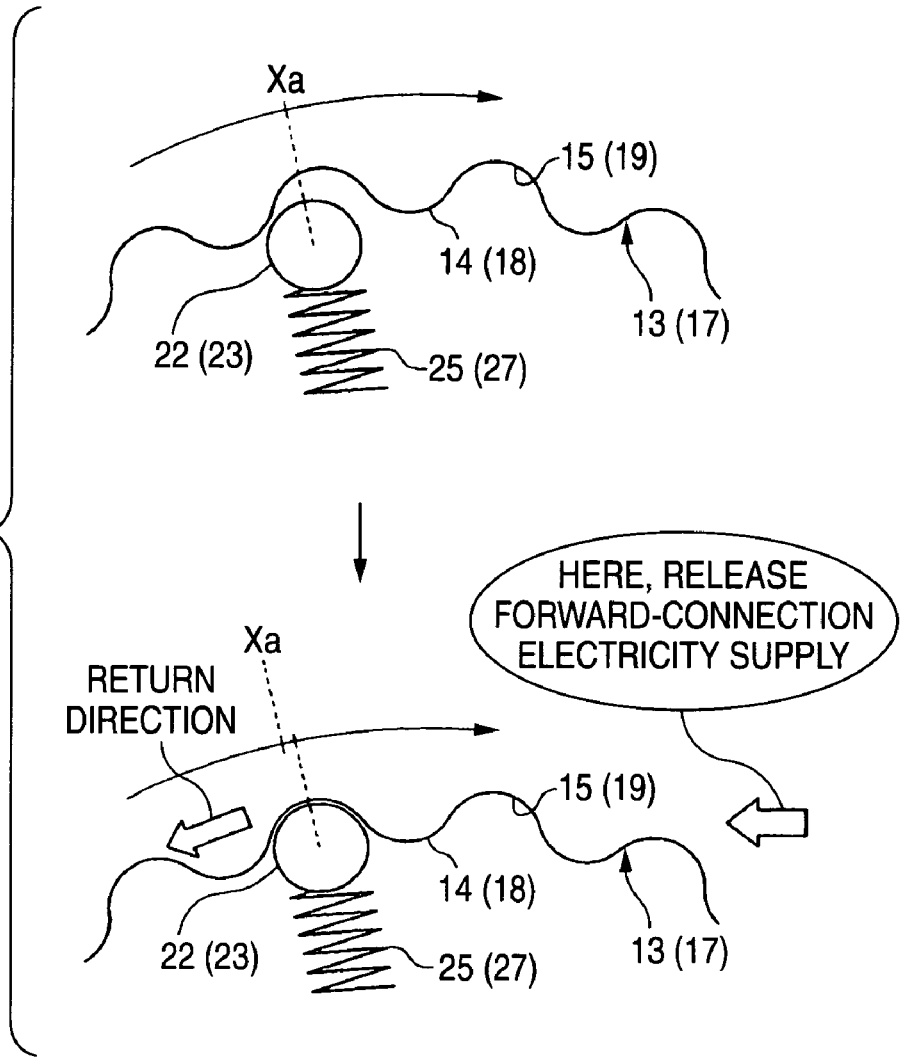
FIG. 10 is an explanatory view of an operation in stopping a rotational operation of a dial knob.

Here, the actual dial knob stop position is set, as shown in FIG. 10, to a middle position Xa where the click peace 22(23) climbs a slope of the detent crest 14(18). This is because when the click peace 22(23) falls down the slope of the detent crest 14(18) due to a biasing force of a biasing member 25(27) after the dial knob 10 is fixed, the dial knob 10 is made to return with rotation by a slight quantity and hence, the position of the dial knob 10 is displaced from the middle position Xa which is the dial knob stop position thus returning the dial knob 10 to a non-fixed state. Due to such an operation, even after the dial knob 10 arrives at the dial knob stop position and is fixed, the fixed state can be released with no problem thus enabling the subsequent rotational operation of the dial knob 10.

Accordingly, in this embodiment, by making use of the magnet magnetic field Ha of the permanent magnet 35 forming a portion of the case part of the operating switch 7, this magnet magnetic field Ha and the coil magnetic field Hb generated by the coil 29 for changing over click feeling are cooperatively used to change over the click feeling generated by the dial knob 10 and fixing of the dial knob 10. Accordingly, the click generated in the dial knob 10 can be freely changed over among three stages consisting of large click feeling, small click feeling and a fixed state. Even when one dial knob 10 is used in common among a plurality of selection functions as in the case of this embodiment, by generating the click which differs for every function, the operating switch 7 constitutes operating switches corresponding to respective selection functions thus highly effectively enhancing the switch operating feeling.

Further, the multi-stage detent mechanism 11 of this embodiment is a mechanism for changing over the click by making use of a magnetic field generated by the permanent magnet 35 as an assist magnetic field (auxiliary magnetic field) in changing over the click generated by the dial knob 10 in three stages consisting of large click, small click and the fixed state. Accordingly, it is unnecessary to apply the control of the switch controller 37 to this type of permanent magnet 37. Further, in changing over the click feeling of the dial knob 10, it is sufficient to perform the control processing which only changes the electricity supply direction of the coil 29 or prevents the flow of an electric current thus realizing the changeover of the click of the dial knob 10 with the simple control processing.

According to the arrangement of the present invention, the following advantageous effects can be realized.

(1) The multi-stage detent mechanism 11 of this embodiment is a mechanism which changes over, by making use of the magnetic field generated by the permanent magnet 35 as the assist magnetic field, the click generated by the dial knob 10 in three stages consisting of large click, small click and the fixed state. Accordingly, in changing over the click feeling of the dial knob 10, it is sufficient to perform the control processing which only changes the electricity supply direction of the coil 29 or prevents the flow of an electric current thus realizing the changeover of the click of the dial knob 10 with the simple control processing.

(2) The multi-stage detent mechanism 11 of this embodiment adopts the mechanism which allows the first-stage detent mechanism 11*a* for generating small click and the second-stage detent mechanism 11*b* for generating large click to use the plunger case 20 in common and hence, the number of parts necessary for such case parts can be decreased thus realizing the miniaturization of device size and the reduction of part cost.

(3) The yoke 9 or the shaft 10*b* of the operating switch 7 are used as the magnetic path through which the magnet magnetic field Ha of the magnet 35 passes, and the coil 29 is arranged such that the coil magnetic field Hb generated by the coil 29 take the direction along the magnetic path of the magnet magnetic field Ha. Due to such a arrangement, in superposing the magnet magnetic field Ha of the magnet 35 and the coil magnetic field Hb of the coil 29 to each other, the coil magnetic field Hb can be easily applied to the magnet magnetic field Ha thus surely allowing or inhibiting the rotational operation of the dial knob 10.

(4) In rotatably operating the dial knob 10, when the rotary operating position of the dial knob 10 arrives at the knob rotation stop position where the rotational operation of the dial knob 10 is restricted, by performing the detent changeover which brings the dial knob 10 whose rotational operation has been allowed into a fixed state thus imparting feeling of wall to the dial knob 10 at the knob rotation stop position. Due to such a arrangement, this kind of rotational-operation-range-non-limited operating switch 7 can also be used as a rotational-operation-range-limited operating switch with a limited rotational operation range.

(5) The operating switch apparatus 3 of this embodiment uses the GUI in which various item buttons 5 are displayed on the display 4, and button selection decision operation is performed by selectively operating various item buttons 5 using the dial knob 10. Accordingly, even when the structure which uses one dial knob 10 in common among a plurality of switch selection functions, in this case, it is possible to inform an operator of a possible operation quantity range and items selectable among the selection items at this point of time using the selection function in an operative state. Accordingly, the operator can recognize the operating position to be operated at the time of operating the operating switch 7 thus ensuring the high operability of the operating switch 7.

Here, this embodiment is not limited to the above-mentioned arrangements and may be modified in following modes.

The multi-stage detent mechanism is not always limited to the structure which allows the plurality of click feeling to use one plunger case 20 in common. For example, this embodiment may adopt the structure in which the respective detent mechanisms 11 . . . are formed as independent units having respective cases, and a drive state is changed over by changing over the presence or non-presence of attraction using the respective dedicated coils. Further, in using such structure, the number of steps of detent mechanism may not be always two and may be three or more.

This embodiment is not limited to the case in which the uneven pattern 13(17) is formed on the dial-knob-10 side and the click piece 22(23) is formed on the yoke-9 side and this combination may be reversed.

The positional relationship between the uneven pattern 13(17) and the click piece 22(23) is not limited to the case in which the click piece 22(23) is positioned at the radially inner side of the dial knob 10 and the uneven pattern 13(17) is positioned at the radially outer side of the dial knob 10. This arrangement relationship may be reversed.

The operating switch 7 is not limited to the rotational-operation-type switch which operates the dial knob 10 which constitutes the operating portion in the rotational direction and may be a slide-operation-type switch which operates the operating portion in the lateral direction, for example.

The changeover of click feeling of the operating switch 7, when the display 4 is of a touch-panel-type display, for example, may be performed based on a panel touch operation or based on a rotation operation quantity of the encoder 36 since the rotation operation quantity of the dial knob 10 is detected by the encoder 36.

Item values on click feeling such as the shape and the interval of the detent crest 14(18) of each detent mechanism 11*a*, 11*b*, the size of the click piece 22(23), a biasing force of the biasing member 25(27) and the like can be suitably and freely set and changed.

The auxiliary magnetic field generating member is not always limited to the permanent magnet 35 and may be an electromagnet, for example.

The click piece 22(23) may not be always limited to the spherical shape and may be formed in a shape having a removal preventing portion for preventing the removal of the click piece 22(23) from the plunger case 20, for example.

The operating switch apparatus 3 of this embodiment is not always limited to the vehicle-loaded switch apparatus, and an object on which the switch apparatus is mounted is not particularly limited provided that the operating switch apparatus 3 is a switch apparatus having an operating system such as an electric appliance, for example.

Next, technical concepts which can be grasped based on the above-mentioned embodiment and other embodiments are explained hereinafter together with advantageous effects acquired by these embodiments.

(1) According to the present invention, the detent changeover switch apparatus includes a function changeover element which changes over the selection functions of the operating portion based on the detection quantity of the detector, and a display controller which performs an image display of the display screen corresponding to the selected function on the display element when the controller controls whether or not the operating portion is allowed to be operated based on the selected function set by the function changeover element. In this case, since the image screen corresponding to the selected function selected and designated time to time is displayed on the display element and hence, even when one operating portion is used in common among the plurality of selection functions as in the case of this embodiment, it is possible to a possible to display an operation quantity range of the operating portion and items selectable among the selection items at this point of time using the selection function on the display in such an operative state. Further, it is also possible to inform an operator of the detail of operations operable by the operating portion for every selected function. Accordingly, it is possible to avoid the case in which the operator cannot recognize the operating position to be operated at the time of operating the operating portion thus ensuring the high operability of the operating portion.

According to the above-mentioned technical concept (1) of the present invention, the auxiliary magnetic field generating member is a permanent magnet. In this case, when an electromagnet is used as the auxiliary magnetic field generating member, for example, it is necessary to perform an electricity supply control of the electromagnet. By adopting the electromagnet having the above-mentioned arrangement, this type of electricity supply control is unnecessary thus highly effectively simplifying the control processing in changing over the click feeling and the fixed state of the operating portion.

What is claimed is:

1. A detent changeover switch apparatus performing a selection function operation, comprising:

a housing;

an operating portion to be operated by an operator to rotate with respect to the housing;

an operating shaft extending integrally from the operating portion;

a plurality of detent mechanisms, each including a detent member and a piece member rotatable relatively to a detent crest member to generate a click feeling;

an electromagnet that is provided at the housing and selectively fixes the crest members of the detent mechanisms to the housing by a magnetic attracting action;

an auxiliary magnetic field generating member capable of imparting an auxiliary electric field to a magnetic circuit generated by the electromagnet;

a magnetic attracting member that fixes the operating shaft to the housing by the magnetic attracting action of the electromagnet when a large magnetic field is imparted to the magnetic attracting member;

a detector that detects an operation state when the operator operates the operating portion; and a controller that performs a drive control of the electromagnet based on a detection quantity of the detector for changing over a circuit state of a magnetic circuit generated in the housing by the electromagnet and the auxiliary magnetic field generating member, thereby changing over the click feeling and a fixed state of the operating portion.

2. The detent changeover switch apparatus according to claim 1, wherein one of the detent mechanisms includes an interlocking member movable together with the operating shaft, a mounting member mounted on the operating shaft in a relatively movable manner, and a part group for large click positioned between the interlocking member and the mounting member, the other of the detent mechanisms includes the mounting member, a support member fixed to the housing and a part group for small click positioned between the mounting member and the support member, a magnetic body magnetically attractable to the electromagnet is integrally mounted on the mounting member, and the controller changes over a drive state of the electromagnet among a non-electricity-supply state, a backward connection electricity supply state and a forward connection electricity supply state to bring a magnetic attracting state between the electromagnet and the magnetic body and a magnetic attracting state between the magnet attracting member and the housing into different states, respectively, for changing over the click feeling and the fixed state of the operating portion.

3. The detent changeover switch apparatus according to claim 2, wherein the auxiliary magnetic field generating member generates the auxiliary magnetic field by forming a magnetic path using the housing and the operating shaft made of a magnetic material, the electromagnet has an electromagnetic magnetic field directed along the magnetic path of the auxiliary magnetic field, and when the operating portion is changed over into the fixed state, the controller performs the drive control of the electromagnet for changing over the magnetic field of a magnetic circuit generated by the housing and the operating shaft.

* * * * *